United States Patent [19]

Dudt

[11] 4,239,718

[45] Dec. 16, 1980

[54] PROCESS FOR AGGLOMERATING FINELY DIVIDED CARBONACEOUS SOLIDS

[75] Inventor: Philip J. Dudt, Scenery Hill, Pa.

[73] Assignee: Continental Oil Company, Stamford, Conn.

[21] Appl. No.: 31,250

[22] Filed: Apr. 18, 1979

[51] Int. Cl.[3] ..... B01J 2/06

[52] U.S. Cl. ..... 264/117

[58] Field of Search ..... 264/117

[56] References Cited

U.S. PATENT DOCUMENTS

| | | | |
|---|---|---|---|
| 3,591,671 | 7/1971 | Burt et al. | 264/117 |
| 3,617,228 | 11/1971 | Smit | 264/117 |
| 3,665,066 | 5/1972 | Capes et al. | 264/117 |
| 3,865,916 | 2/1975 | Visser et al. | 264/117 |

*Primary Examiner*—Donald E. Czaja
*Assistant Examiner*—James R. Hall
*Attorney, Agent, or Firm*—F. Lindsey Scott; William A. Mikesell, Jr.

[57] ABSTRACT

In a process for agglomerating finely divided carbonaceous solids from an aqueous slurry containing from about 10 to 40 weight percent finely divided solids comprising finely divided carbonaceous solids and finely divided inorganic solids, comprising:

(a) mixing the slurry with an amount of oil to produce agglomerates of the carbonaceous solids containing from about 10 to 15 weight percent oil; and, (b) recovering the agglomerates as a product, an improvement comprising:

(c) admixing oil in an amount of about 40 to 70 weight percent based on the weight of finely divided solids with the slurry to produce a mixture; and, (d) mixing clean, finely divided carbonaceous solids with the mixture to produce agglomerates containing from about 12 to about 15 weight percent oil, whereby an aqueous slurry containing finely divided carbonaceous solids which do not agglomerate upon the addition of from about 10 to 30 weight percent oil can be agglomerated.

5 Claims, 1 Drawing Figure

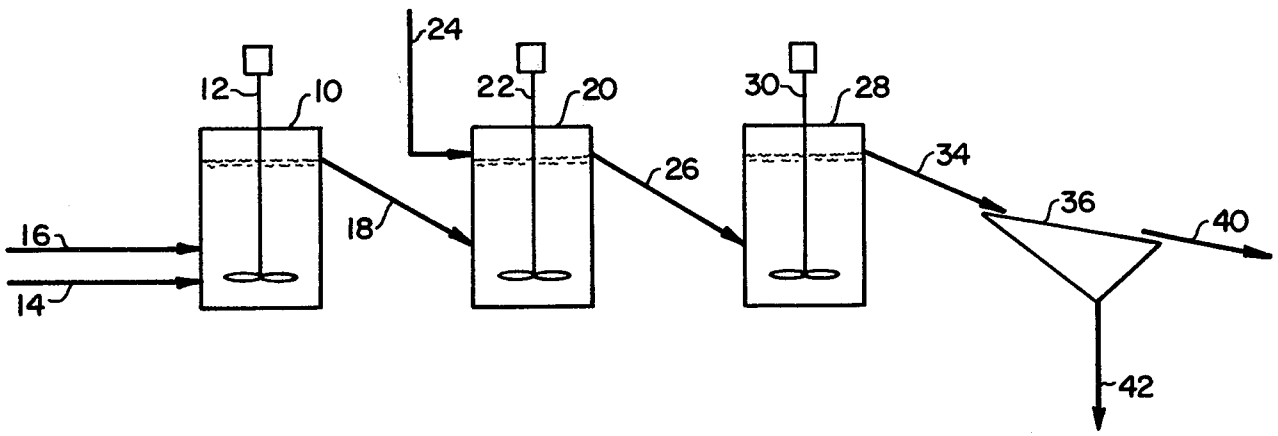
16
14
12
10
18
24
22
20
26
30
28
34
36
40
42

PROCESS FOR AGGLOMERATING FINELY DIVIDED CARBONACEOUS SOLIDS

This invention relates to the production of agglomerate particles from finely divided carbonaceous solids.

This invention further relates to the agglomeration of carbonaceous solids from aqueous slurries wherein the carbonaceous solids do not agglomerate upon the addition of amounts of oil usually sufficient to agglomerate such carbonaceous solids.

In many industrial applications, finely divided carbonaceous particles are produced as a by-product and unless a suitable method is available for using such materials as fuel or the like, the finely divided carbonaceous solids constitute a waste. In some instances quantities of finely divided carbonaceous solids are produced in a dry form while in other instances they may be produced in the form of aqueous slurries containing the finely divided solids. For instance, in coal mining operations, finely divided coal is produced as a by-product which is normally not completely recovered in coal cleaning operations and the like. In many instances aqueous solutions containing such finely divided coal and finely divided inorganic solids are pumped into holding ponds or the like commonly referred to in the industry as blackwater ponds. In many instances water is recycled or lost from such ponds as a result of evaporation or the like over a period of time with the result that, in many parts of the country, ponds containing substantial quantities of such finely divided carbonaceous solids exist. In many instances these ponds have been caused to overflow by heavy rains and the like thus resulting in washing the finely divided coal into nearby streams where it constitutes an unsightly pollutant. A considerable amount of effort has been directed to methods whereby these finely divided carbonaceous solids, i.e. coal can be recovered from such blackwater ponds. As a result of the continuing interest in methods for converting these finely divided carbonaceous solids into usable industrial fuels, a continuing search has been directed to methods for agglomerating such particles.

It has long been known that such finely-divided carbonaceous particles can be mixed with oil in the presence of water to form agglomerates. Many variations in such processes are known. Some such processes are shown in U.S. Pat. No. 3,665,066 issued May 23, 1972 to Capes et al. and U.S. Pat. No. 3,268,071 issued Aug. 23, 1966 to Puddington et al.

It has been found that some blackwater pond slurries and some aqueous slurries produced in the cleaning of coals from certain mines do not result in the production of agglomerates of finely divided carbonaceous solids and oil when mixed with quantities of oil sufficient to agglomerate the carbonaceous solids contained in the aqueous slurry. As a result of the interset in recovering the carbonaceous solids from such aqueous streams, a continuing search has been directed to the development of processes which will be effective in agglomerating finely divided solids contained in such aqueous slurries.

It has now been found that in processes for agglomerating finely divided carbonaceous solids contained in aqueous slurries containing from about 10 to about 40 weight percent solids, the solids comprising finely divided carbonaceous solids and finely divided inorganic solids, by mixing the slurry with oil in an amount sufficient to produce agglomerates of the carbonaceous solids containing from about 12 to about 15 weight percent oil, and thereafter recovering the agglomerates as a product, in some instances the carbonaceous solids are not agglomerated by such treatment. Such non-agglomerating carbonaceous solids are readily recovered by the admixing of a large excess of oil with the aqueous slurry to produce a mixture which is thereafter mixed with an additional quantity of clean, finely divided carbonaceous solids to produce agglomerates containing from 12 to about 15 weight percent oil.

FIG. 1 is a schematic diagram of a process wherein the improvement of the present invention is effective.

In the FIGURE, a vessel 10 which includes a stirrer 12, is shown. A slurry inlet 14 and an oil inlet 16 are provided for charging an aqueous slurry containing from about 10 to about 40 weight percent solids and oil respectively into vessel 10. The streams charged to vessel 10 through lines 14 and 16 are mixed to produce a mixture which is passed through a line 18 to a second vessel 20. A stream of clean, finely divided carbonaceous solids is added to vessel 20 through a line 24 and the resulting mixture in vessel 20 is stirred by means of a stirrer 22. The resulting mixture which contains agglomerates of carbonaceous solids is passed through a line 26 to a third vessel 28 where the agitation is continued, although desirably at a lower rate to produce larger agglomerates which are passed via a line 34 to a screen 36. The product agglomerates are recovered from screen 36 via a line 40 with the aqueous discharge containing the inorganic solids, clays and the like being recovered through a line 42.

In the practice of the present invention, the aqueous slurry charged to vessel 10 comprises an aqueous slurry containing from about 10 to about 40 weight percent solids. Preferably, the slurry contains from about 20 to about 35 weight percent solids. In the practice of such agglomeration methods heretofore, the oil has been added, with vigorous mixing, in an amount equal to from about 10 to about 30 weight percent based upon the weight of the carbonaceous solids contained in the aqueous slurry. As indicated previously, some such slurries do not yield agglomerates of the carbonaceous solids and oil when so treated. It has now been found that, in the treatment of such slurries, it is desirable that the oil be added in an amount to from about 40 to about 70 weight percent based on the weight of all the finely divided solids contained in the aqueous slurry. Clearly, a large excess of oil is added and even with vigorous agitation in vessel 10, inversion of the mixture does not occur. The term "inversion" is used to refer to the phenomonon wherein the carbonaceous solids become coated with oil and begin to agglomerate and separate from the aqueous medium. Clearly, the use of the method of the present invention is not necessary with many aqueous slurries, and the aqueous slurries with which improvement of the present invention is necessary can be generally described as those wherein the finely divided carbonaceous solids contained in the aqueous slurries do not agglomerate upon mixing after the addition of from 10 to 30 weight percent oil based on the weight of the carbonaceous solids. Such aquantities of oil are normally effective to agglomerate the carbonaceous solids and produce agglomerates containing the desired 12 to 15 weight percent oil. It has been found that, by the improvement of the present invention, large excesses of oil should be used in vessel 10 and, even with the use of such large quantities of oil, the carbonaceous solids do not normally agglomerate. Instead, it has been found that substantially all the solids, both carbonaceous and inorganic, contained in the aqueous slurry tend to be coated with oil. Still, no inversion is observed and no agglomeration is observed. The agitation in vessel 10 is at a relatively high mixing rate, i.e. from about 0.3 to about 1.25 hp/ft.$^3$ Values from about 0.4 to about 0.7 hp/ft.$^3$ are more common. The degree of agitation used is subject to considerable variation depending upon the particular solids subjected to treatment, the type oil used and the like. In the practice of the improvement of the present invention, the resulting mixture is passed via line 18 to a second vessel which is the inverter vessel wherein inversion occurs. The inversion occurs as a second stream of clean, finely divided, carbonaceous solids is added to the mixture passed to vessel 20 through line 18. The stream of clean, carbonaceous solids is added in an amount sufficient to produce agglomerates of the carbonaceous solids containing from 12 to 15 weight percent oil. The oil is substantially all used in the production of such agglomerates with the inorganic solids being unaffected by the agglomeration process. While Applicant does not wish to be bound by any particular theory, it appears that, in certain aqueous slurries, the clays are so intimately associated with the carbonaceous solids that the normal agglomeration processes cannot occur. In the practice of the improvement of the present invention, all the finely divided solids are coated with oil and thereafter passed to the second vessel wherein the inversion occurs and, in essence, the finely divided clean, carbonaceous solids selectively adhere to the oil and remove the oil from the finely divided inorganic solids and the like. The net result is that the finely divided carbonaceous solids initially present in the aqueous slurry are recovered as agglomerates with the finely divided inorganic solids being unagglomerated and readily recovered with the aqueous portion of the slurry. The agitation rate in vessel 20 is substantially the same as that in vessel 10, although some variation may occur due to the difference in solids concentration and the like.

It is noted that heretofore such agglomeration processes, while they have included the addition of aqueous slurries containing carbonaceous solids and oil to an inversion vessel, have not used the addition of cleaned streams of carbonaceous solids in addition to the aqueous slurry containing the carbonaceous solids. The addition of the cleaned carbonaceous solids stream into the inverter vessel in addition to the two streams normally used has not been known heretofore to Applicant's knowledge. As indicated aove, in the treatment of such slurries which resist agglomeration by normal processes, a surprising and unobvious result is accomplished by the improvement of the present invention.

The use of the third vessel 28 to further grow the agglomerates is in accordance with techniques known to those in the art and forms no part of the present invention.

While various slurries of finely divided carbonaceous solids can be used, only those slurries which resist oil agglomeration when the normally used quantities of oil are added, require treatment in accordance with the improvement of the present invention. With such resistant slurries, the recovery of the carbonaceous solids contained therein is now possible by the practice of the improvement of the present invention. As indicated above, quantities of oil from about 40 to about 80 weight percent based on the quantity of solids contained in the aqueous slurry are suitable. Particularly desirable results have been obtained when from about 50 to about 60 weight percent oil was used.

The addition of the clean, carbonaceous solids through line 24 is accomplished either by the addition of the dry solids, or the solids can be added in aqueous slurry. The concentration of the solids in the aqueous slurry can vary as convenient for handling purposes. Normally processes wherein the improvement of the present invention is used would be operated in close conjunction with a coal cleaning plant or the like wherein streams of clean, finely divided carbonaceous solids are readily available.

Oils suitable for use in the present invention are typically petroleum-derived oils, although tars and oils derived from coal or the like may be used if available. Some suitable oils are pentane, hexane, heptane, benzene, toluene, gasoline, kerosene, diesel fuel, gas oil, residual fuel oils, heavy gas oil, mixtures thereof and the like. The oils used are typically derived from petroluem and sich oils generally are suitable so long as the boiling point is sufficiently high so that little no vaporization occurs during the mixing step, and so long as the oil is suitably liquid at the processing conditions. Desirably the oil is selected from such oils as kerosene, diesel oil, fuel oil and the like. Such oils are well known to those skilled in the art and need not be discussed further.

The finely divided solids are normally of a size below about 28 mesh Tyler Standard screen. The aqueous slurry is typically processed by the removel of lage particles of foreign material, large particules of carbonaceous or inorganic solids and the like prior to charging the slurry to the process. Such slurry treaments are well known to those skilled in the art and need not be discussed further.

Having thus described the present invention with respect to certain of its preferred embodiments, it is pointed out that the embodiments discussed above, while preferred, are illustrative rather than limiting in nature. Many variations and modifications are possible within the scope of the present invention and it is expected that many such variations and modifications may appear obvious or desirable to those skilled in the art upon a review of the foregoing description of preferred embodiments.

Having thus described the invention, I claim:

1. In a process for agglomerating finely divided carbonaceous solids in an aqueous slurry containing about 10 to 40 weight percent finely divided solids, said finely divided solids comprising said finely divided carbonaceous solids and finely divided inroganic solids said process comprising:

(a) mixing said slurry with an amount of oil to produce agglomerates of said carbonaceous solids containing from about 12 to 15 weight percent oil; and, (b) recovering said agglomerates as a product, an improvement comprising:

(c) admixing said oil in an amount of about 40 to 70 weight percent based on the weight of said finely divided solids with said slurry to produce a mixture of said oil and said slurry; and (d) admixing clean finely divided carbonaceous solids with said mixture at a mixing rate of about 0.3 to 1.25 hp/ft$^3$ to invert said mixture and produce agglomerates of said carbonaceous solids and oil, said agglomerates containing from about 12 to 15 weight percent oil, whereby a slurry containing said finely divided carbonaceous solids which do not agglomerate upon mixing with from about 10 to 30 weight percent oil based on the weight of said carbonaceous solids can be agglomerated.

2. The process of claim 1 wherein step (d) said added finely divided carbonaceous solids are substantially dry.

3. The process of claim 1 wherein step (d) said finely divided carbonaceous solids are added as an aqueous slurry.

4. The process of claim 1 wherein step (d) said carbonaceous solids are finely divided coal.

5. The process of claim 1 wherein the mixture produced in step (d) is passed to further agglomeration prior to recovering said agglomerates.

* * * * *